US011685560B2

(12) United States Patent
Shibao et al.

(10) Patent No.: US 11,685,560 B2
(45) Date of Patent: Jun. 27, 2023

(54) PACKAGING DEVICE AND PACKAGING METHOD FOR PACKAGING MATERIAL

(71) Applicant: OSAKA SEALING PRINTING CO., LTD., Osaka (JP)

(72) Inventors: Kenichi Shibao, Osaka (JP); Akinori Ishizuka, Habikino (JP); Naoki Asakura, Sakai (JP)

(73) Assignee: OSAKA SEALING PRINTING CO., LTD., Osaka (JP)

( * ) Notice: Subject to any disclaimer, the term of this patent is extended or adjusted under 35 U.S.C. 154(b) by 0 days.

(21) Appl. No.: 17/784,636

(22) PCT Filed: Dec. 24, 2019

(86) PCT No.: PCT/JP2019/050606
§ 371 (c)(1),
(2) Date: Oct. 21, 2022

(87) PCT Pub. No.: WO2021/130854
PCT Pub. Date: Jul. 1, 2021

(65) Prior Publication Data

US 2023/0118777 A1 Apr. 20, 2023

(51) Int. Cl.
*B65B 41/04* (2006.01)
*B65B 7/28* (2006.01)
(Continued)

(52) U.S. Cl.
CPC ..... *B65B 7/2864* (2013.01); *B65B 35/24* (2013.01); *B65B 41/04* (2013.01); *B65B 57/14* (2013.01)

(58) Field of Classification Search
USPC ..... 53/399
See application file for complete search history.

(56) References Cited

U.S. PATENT DOCUMENTS 4,841,715 A * 6/1989 Suga ..... B65B 11/105 53/210
2020/0307916 A1* 10/2020 Schröder ..... B65G 47/642
(Continued)

FOREIGN PATENT DOCUMENTS

JP S62-146708 U 9/1987
JP H08-133241 A 5/1996
(Continued)

*Primary Examiner* — Chinyere J Rushing-Tucker
(74) *Attorney, Agent, or Firm* — Maschoff Brennan

(57) ABSTRACT

A packaging device for packaging material includes: a carry-in conveyor configured to carry in a food container along a conveyance direction; a carry-out conveyor configured to carry out the food container along the conveyance direction; a conveyor moving mechanism configured to move at least one of the carry-in conveyor or the carry-out conveyor; a packaging material pressing mechanism configured to press a band-shaped packaging material against the food container conveyed between the carry-in conveyor and the carry-out conveyor and to attach the band-shaped packaging material to the food container; and a control device configured to cause the conveyor moving mechanism to move at least one of the carry-in conveyor or the carry-out conveyor to thereby form an attachment space between the carry-in conveyor and the carry-out conveyor where the packaging material pressing mechanism attaches the band-shaped packaging material to the food container.

5 Claims, 12 Drawing Sheets

(51) Int. Cl.
*B65B 57/14* (2006.01)
*B65B 35/24* (2006.01)

(56) References Cited

U.S. PATENT DOCUMENTS

2020/0346797 A1 11/2020 Ishizuka et al.
2022/0234771 A1* 7/2022 Bruhn ..... B65G 15/14

FOREIGN PATENT DOCUMENTS

JP H10-045103 A 2/1998
JP 2012091854 A 5/2012
JP 2013-112414 A 6/2013
JP 2017-141044 A 8/2017
WO 2019106825 A1 6/2019

* cited by examiner

PACKAGING DEVICE AND PACKAGING METHOD FOR PACKAGING MATERIAL

TECHNICAL FIELD

The present invention relates to a packaging device and a packaging method for a packaging material for attaching a band-shaped packaging material to an object such as a food container conveyed by, for example, a carry-in conveyor.

BACKGROUND ART

As described in Patent Document 1, a known apparatus for sticking a wrapper band includes a carry-in conveyor on which a container with a lid is placed and conveyed, a transfer conveyor on which the container received from the carry-in conveyor is placed and conveyed, and a sticking means for sticking an adhesive tape to the container that has reached a crossover portion between these conveyors. A wrapper band is wound around and sticked to the container conveyed to the crossover portion.

CITATION LIST

Patent Document

Patent Document 1: Japanese Patent Application Publication No. 2013-112414

SUMMARY OF THE INVENTION

Technical Problem

The apparatus for sticking a wrapper band as described in Patent Document 1, however, always includes the crossover portion, and thus, an object has to pass through this crossover portion. While the container passes through the crossover portion, the posture of the container becomes unstable, and the wrapper band has to be sticked in this unstable state, disadvantageously.

It is therefore an object of the present invention to enable attachment of a band-shaped packaging material to an object while maintaining posture of the object.

Solution to Problem

To achieve the object, according to the present invention, an attachment space for attaching a band-shaped packaging material is obtained by moving at least one of a carry-in conveyor or a carry-out conveyor.

Specifically, in a first aspect, a packaging device includes: a carry-in conveyor configured to carry in an object along a conveyance direction; a carry-out conveyor configured to carry out the object along the conveyance direction; a conveyor moving mechanism configured to move at least one of the carry-in conveyor or the carry-out conveyor; a packaging material pressing mechanism configured to press a band-shaped packaging material against the object conveyed between the carry-in conveyor and the carry-out conveyor, and to attach the band-shaped packaging material to the object; and a control device configured to cause the conveyor moving mechanism to move at least one of the carry-in conveyor or the carry-out conveyor to thereby form an attachment space between the carry-in conveyor and the carry-out conveyor, the attachment space being formed such that the band-shaped packaging material is attached to the object by the packaging material pressing mechanism in the attachment space.

With this configuration, when the object is conveyed, the control device moves at least one of the carry-in conveyor or the carry-out conveyor to form an attachment space between the carry-in conveyor and the carry-out conveyor, and in this attachment space, the packaging material pressing mechanism attaches the band-shaped packaging material to the object. Thus, even a band-shaped packaging material extending from the side surface to the bottom surface of the object can be attached as intended. After the attachment, it is sufficient to convey the object after the carry-in conveyor and the carry-out conveyor have returned to the original positions. Thus, the object can be conveyed with stability.

In a second aspect, in the device of the first aspect, the packaging material pressing mechanism includes a packaging material holding mechanism configured to place the band-shaped packaging material on an upper surface of the object such that both end portions of the band-shaped packaging material hang down at side surfaces of the object, an upper surface pressing mechanism configured to press the band-shaped packaging material supplied by the packaging material holding mechanism against at least the upper surface of the object, and a pair of bottom folding rollers configured to move horizontally toward each other, the pair of bottom folding rollers being configured to press the both end portions of band-shaped packaging material hanging down at both side surfaces of the band-shaped packaging material against a bottom surface of the object and to attach the both end portions of the band-shaped packaging material to the bottom surface of the object, and the pair of bottom folding rollers is movable below the object in the attachment space.

With this configuration, in the attachment space, after the band-shaped packaging material has been attached to the upper surface of the object by the upper surface pressing mechanism, the band-shaped packaging material is also attached to the bottom surface of the object by the pair of bottom folding rollers. Thus, the band-shaped packaging material is attached to the object from the bottom surface to the upper surface thereof as intended.

In a third aspect, in the device of the second aspect, the upper surface pressing mechanism includes an upper surface pressing portion configured to press the band-shaped packaging material against the upper surface of the object, and a side surface pressing portion configured to press the band-shaped packaging material against a side surface of the object, and the upper surface pressing portion and the side surface pressing portion are movable upward and downward independently of each other.

With this configuration, after the upper surface pressing portion of the upper surface pressing mechanism presses a center portion of the band-shaped packaging material in the longitudinal direction against the upper surface of the object, the side surface pressing portion is pushed downward so that the band-shaped packaging material is also attached to the side surface of the object.

In a fourth aspect, in the device of the third aspect, the packaging material holding mechanism configured to swing while gripping the both end portions of the band-shaped packaging material, and to place the band-shaped packaging material on the upper surface of the object, and includes a pair of openable clamps configured to release the both end portions of the band-shaped packaging material after the upper surface pressing portion presses the band-shaped packaging material against the upper surface of the object.

With this configuration, the band-shaped packaging material is supplied while extending perpendicularly to the conveyance direction by the pair of clamps. Thus, a subsequent operation by the upper surface pressing mechanism can be easily performed.

In a fifth aspect, in the device of any one of the first to fourth aspects, an elevation object stopper is disposed at the carry-out conveyor and is configured to move downward in attaching the band-shaped packaging material to the object and restrict movement of the object.

With this configuration, the band-shaped packaging material is pushed against the object by the packaging material pressing mechanism to be attached to the object with movement of the object being prevented by the object stopper. Thus, the band-shaped packaging material can be attached as intended. After the attachment of the band-shaped packaging material, the object stopper is moved upward to be retracted so that object is carried out.

A packaging method according to a sixth aspect includes: a preparation step of preparing a packaging device for a packaging material, the packaging device including a carry-in conveyor configured to carry in an object along a conveyance direction, a carry-out conveyor configured to carry out the object along the conveyance direction, a conveyor moving mechanism configured to move at least one of the carry-in conveyor or the carry-out conveyor, and a packaging material pressing mechanism configured to press a band-shaped packaging material against an object conveyed between the carry-in conveyor and the carry-out conveyor and to attach the band-shaped packaging material to the object; a standby step of keeping the carry-out conveyor in a standby position in which a downstream end of the carry-in conveyor and an upstream end of the carry-out conveyor are close to each other; a carry-in detecting step of causing a sensor to detect that the object is carried in to the carry-in conveyor; a retraction step of moving at least one of the carry-in conveyor or the carry-out conveyor to a retraction position after a lapse of a predetermined time from detection of carry-in of the object in the carry-in detecting step; a conveyor stop step of stopping driving of the carry-in conveyor and the carry-out conveyor after the retraction step; a packaging material attaching step of causing the packaging material pressing mechanism to press the band-shaped packaging material against the object and attach the band-shaped packaging material to the object by using an attachment space between the carry-in conveyor and the carry-out conveyor; and a conveyor re-driving step of returning at least one of the carry-in conveyor or the carry-out conveyor to the transit position after the packaging material attaching step, and restarting driving of the carry-in conveyor and the carry-out conveyor.

With this configuration, when the object is carried in, at least one of the carry-in conveyor or the carry-out conveyor is moved to the retraction position, and the attachment space is formed between the carry-in conveyor and the carry-out conveyor so that the packaging material pressing mechanism attaches the band-shaped packaging material to the object in this attachment space. This ensures attachment of even a band-shaped packaging material extending from the side surfaces to the bottom surface of the object. After the attachment, it is sufficient to convey the object after the carry-in conveyor and the carry-out conveyor have returned to the original positions. Thus, the object can be conveyed with stability.

In a seventh aspect, in the method of the sixth aspect, in the packaging material attaching step, the band-shaped packaging material is placed on an upper surface of the object such that both end portions of the band-shaped packaging material hang down at side surfaces of the object, the band-shaped packaging material is pressed against at least the upper surface of the object, and a pair of bottom folding rollers is moved horizontally toward each other such that the both end portions hanging down at the both side surfaces of the band-shaped packaging material are pressed against a bottom surface of the object and attached to the bottom surface in the attachment space.

With this configuration, in the attachment space, the band-shaped packaging material is first attached to the upper surface of the object, and then, both end portions of the band-shaped packaging material hanging down are also attached to the bottom surface of the object by the pair of bottom folding rollers. Thus, the band-shaped packaging material is attached to the object from the bottom surface to the upper surface thereof as intended.

Advantages of Invention

As described above, according to the present invention, it is possible to ensure attachment of a band-shaped packaging material to an object from the upper surface to the bottom surface thereof while maintaining posture of the object.

DESCRIPTION OF EMBODIMENTS

An embodiment of the present invention will be described with reference to the drawings.

Figure 1A:
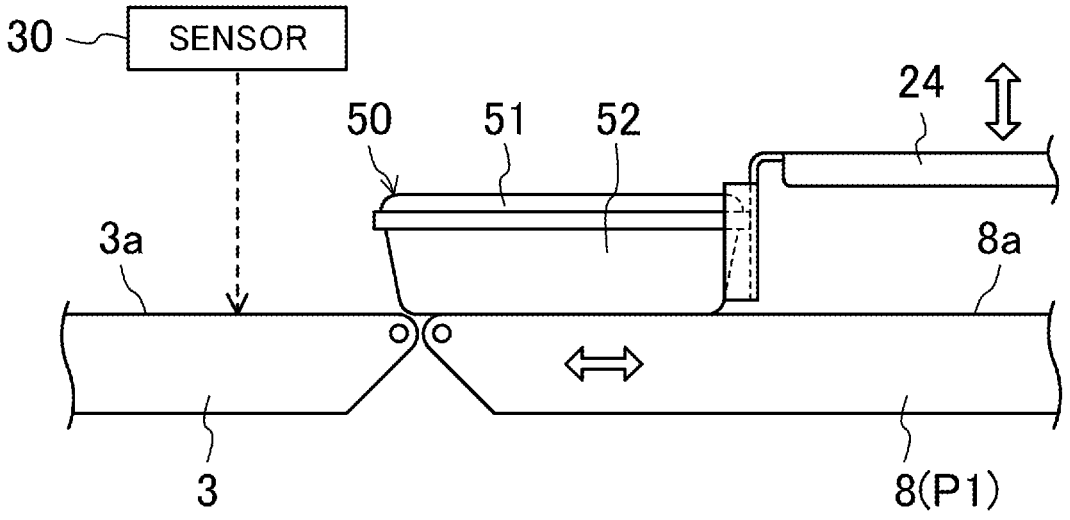
FIG. 1A A front view generally illustrating a carry-in detecting step and a standby step according to an embodiment.
Figure 3:
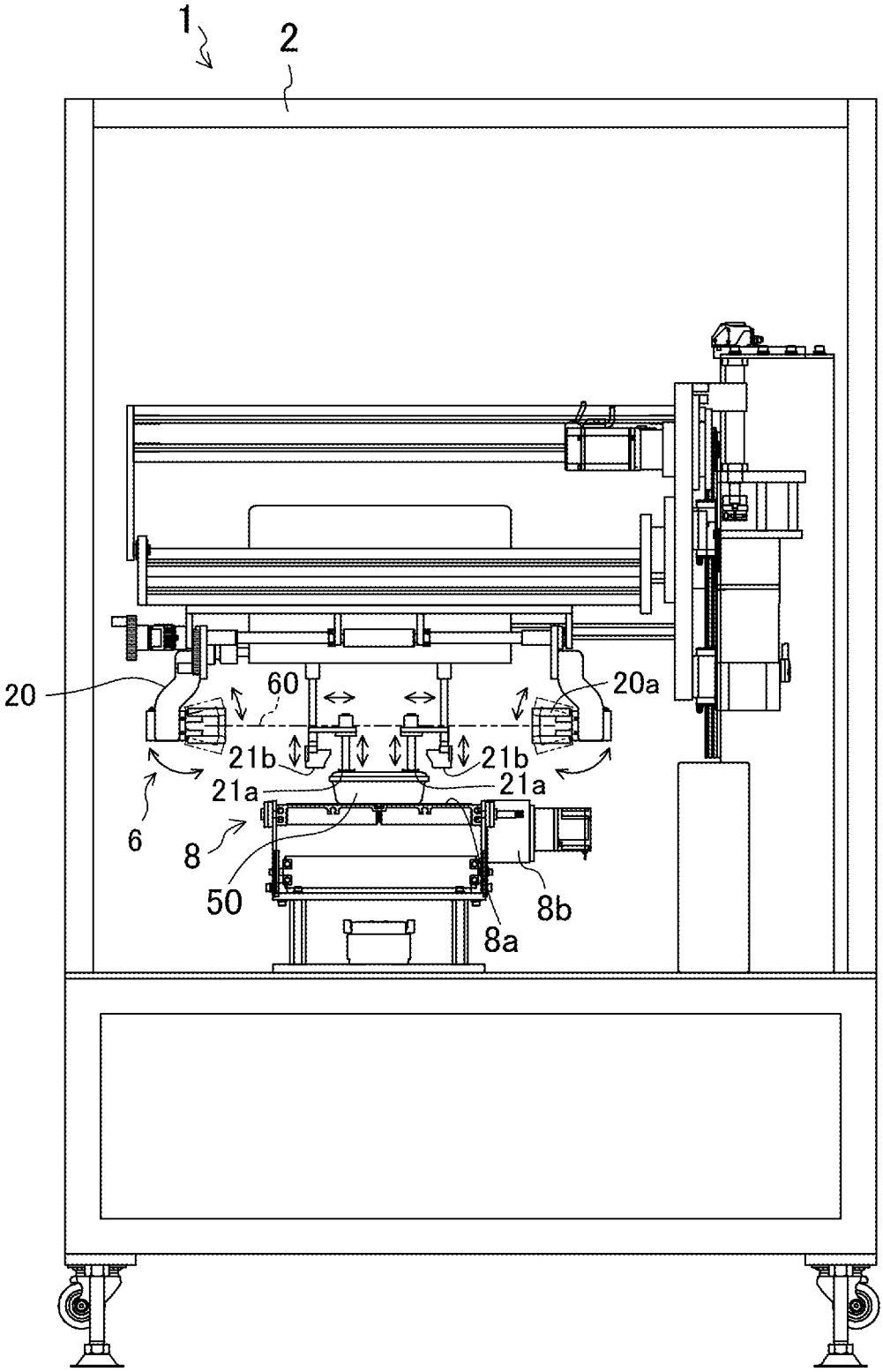
FIG. 3 A right side view illustrating a packaging device for a packaging material according to the embodiment of the present invention.
Figure 4:
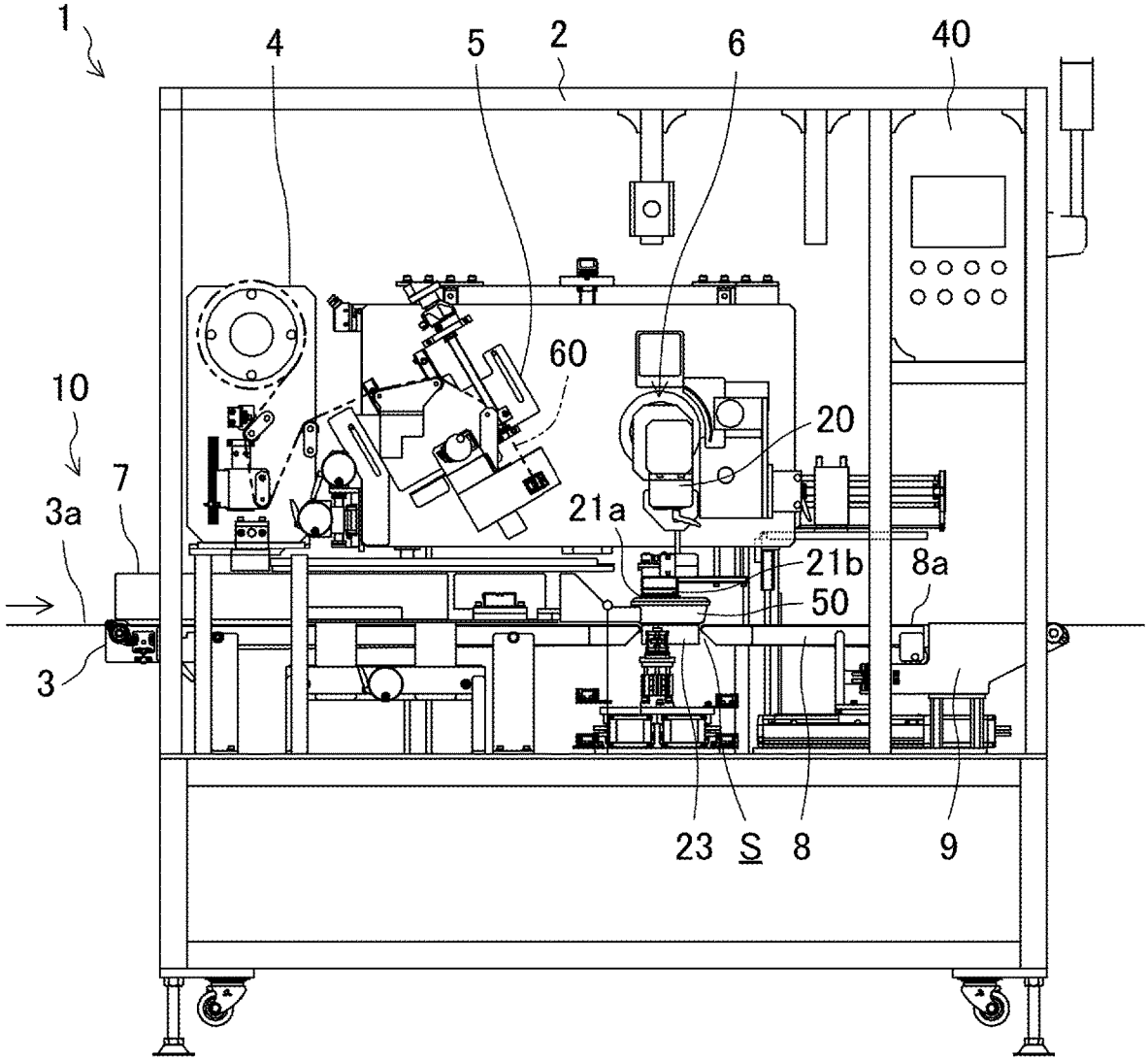
FIG. 4 A front view illustrating the packaging device according to the embodiment of the present invention.

FIGS. 3 and 4 illustrate a packaging device 1 for a packaging material according to an embodiment of the present invention. The packaging device 1 attaches a band-shaped packaging material 60 to a food container 50 as a conveyed object. As illustrated in FIG. 1A, the food container 50 includes, for example, a disc-shaped lid member 51 of a thin resin product and a circular cross-section container portion 52. The circular cross-section container portion 52 containing food is closed with the disc-shaped lid member 51. The band-shaped packaging material 60 is attached by the packaging device 1. The band-shaped packaging material 60 is made of, for example, a film and bibliographic items such as a date is printed thereon, but may be a plain packaging film or paper, for example.

The packaging device 1 includes a base frame 2 constituted by, for example, a metal frame. The base frame 2 is provided with a carry-in conveyor 3 such as a belt conveyor having a conveyance surface 3*a* on which the food container 50 is conveyed from the left to the right in FIG. 4. A packaging material supply mechanism 4, a packaging material printing mechanism 5, and a packaging material pressing mechanism 6, for example, are provided above the carry-in conveyor 3. A pair of lateral guides 7 and 7 for preventing an outflow of the food container 50 from the carry-in conveyor 3 stands on both sides of the carry-in conveyor 3. A carry-out conveyor 8 for carrying the food container 50 in the conveyance direction is provided downstream of the carry-in conveyor 3.

Although not specifically described, the packaging device 1 includes a centering device 10 upstream of the carry-in conveyor 3, for example. The centering device 10 modifies posture of the food container 50 such that the band-shaped packaging material 60 can be easily attached to the food container 50. An operation of the entire packaging device 1 is controlled by a control device 40.

The packaging material pressing mechanism 6 for restricting a movable range of the conveyed food container 50 in the lateral direction of the carry-in conveyor 3 attaches the band-shaped packaging material 60 to the food container 50 centered by the centering device 10. For example, in this embodiment, a large number of band-shaped packaging materials 60 coupled in a direction perpendicular to the conveyance direction are supplied from the packaging material supply mechanism 4, and necessary items are printed on each of the band-shaped packaging materials 60 by the packaging material printing mechanism 5 so that the packaging material pressing mechanism 6 attaches the band-shaped packaging material 60 to each food container 50.

Figure 5:
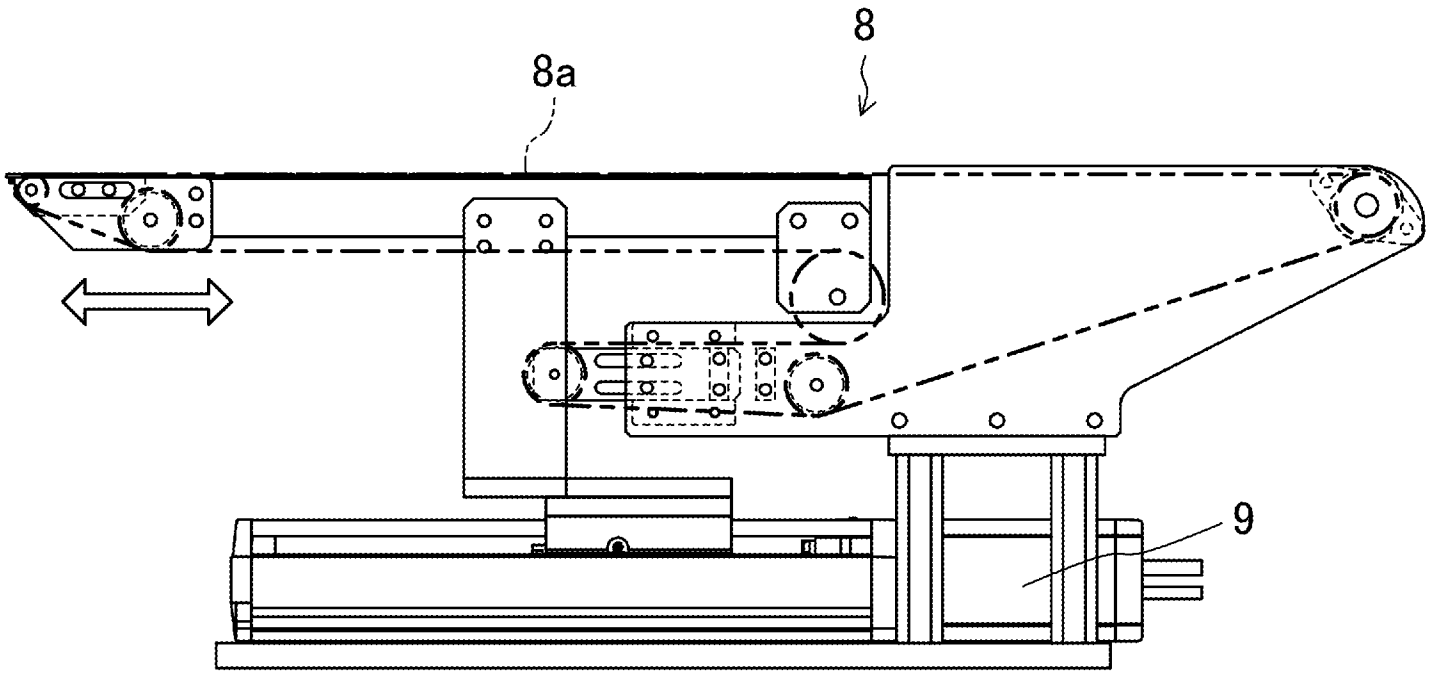
FIG. 5 A front view illustrating a conveyor moving mechanism and a carry-out conveyor according to the embodiment of the present invention.

This embodiment also includes a conveyor moving mechanism 9 configured to move at least one of the carry-in conveyor 3 or the carry-out conveyor 8. As illustrated in FIGS. 3 and 5, for example, the carry-out conveyor 8 includes a conveyance belt constituting a conveyance surface 8*a*, and a carry-out conveyor motor 8*b* for driving the conveyance belt, and is disposed on the conveyor moving mechanism 9. The conveyor moving mechanism 9 is configured to move the carry-out conveyor 8 horizontally to a specified distance relative to the carry-in conveyor 3 by using, for example, a motor or a cylinder, by control of the control device 40, for example. The conveyor moving mechanism 9 moves the carry-out conveyor 8 so that an attachment space S is formed between the carry-in conveyor 3 and the carry-out conveyor 8.

The packaging material pressing mechanism 6 attaches the band-shaped packaging material 60 to an area from the upper surface to the bottom surface of the food container 50 that has reached the attachment space S and is stopped between the carry-in conveyor 3 and the carry-out conveyor 8.

The packaging material pressing mechanism 6 includes a packaging material holding mechanism 20 for placing the band-shaped packaging material 60 on the food container 50 such that both ends of the band-shaped packaging material 60 hang down at the side surfaces of the food container 50. As also illustrated in FIG. 2B, the packaging material holding mechanism 20 includes a pair of clamps 20*a* and 20*a* that swings a band-shaped packaging material 60 supplied from the packaging material supply mechanism 4 and subjected to printing by the packaging material printing mechanism 5 with both ends of the band-shaped packaging material 60 being gripped by the pair of clamps 20*a* and 20*a* and places the band-shaped packaging material 60 on the upper surface of the food container 50. The clamps 20*a* are configured to be opened and closed to thereby grip and release the band-shaped packaging material 60. In the packaging material holding mechanism 20, based on a control signal of the control device 40, an upper surface pressing portion 21*a* (shown in FIG. 2C) described later performs opening/closing operations of pressing the band-shaped packaging material 60 against the upper surface of the food container 50 and then releasing both ends of the band-shaped packaging material 60.

The packaging material pressing mechanism 6 includes an upper surface pressing mechanism 21 of pressing the band-shaped packaging material 60 supplied by the packaging material holding mechanism 20 against at least the upper surface of the food container 50. Specifically, as also illustrated in FIGS. 2C and 2D, the upper surface pressing mechanism 21 includes the upper surface pressing portion 21*a* that presses the band-shaped packaging material 60 against the upper surface of the food container 50 and a side surface pressing portion 21*b* that presses the band-shaped packaging material 60 against a side surface of the food container 50. The upper surface pressing portion 21*a* and the side surface pressing portion 21*b* are movable upward and downward independently of each other.

Specifically, the upper surface pressing portion 21*a* is constituted by, for example, a pair of rod members each having a plate-shaped pressing surface horizontal to the lower end, and is movable upward and downward. The distance between the pair of rod members is also adjustable. When the upper surface pressing portion 21*a* moves downward, the upper surface pressing portion 21*a* presses the band-shaped packaging material 60 against the upper surface of the food container 50. For example, if an adhesive is applied to the lower surface of the band-shaped packaging material 60, the band-shaped packaging material 60 is temporarily fixed to the upper surface of the food container 50.

The side surface pressing portion 21*b* is constituted by, for example, a pair of substantially plate-shaped members respectively disposed at the left and right outer sides of the upper surface pressing portion 21*a* and extending along the conveyance direction. After the upper surface pressing portion 21*a* presses the band-shaped packaging material 60 against the upper surface of the food container 50, the side surface pressing portion 21*b* moves downward and presses both ends of the band-shaped packaging material 60 against the side surfaces of the food container 50.

Figure 2A:
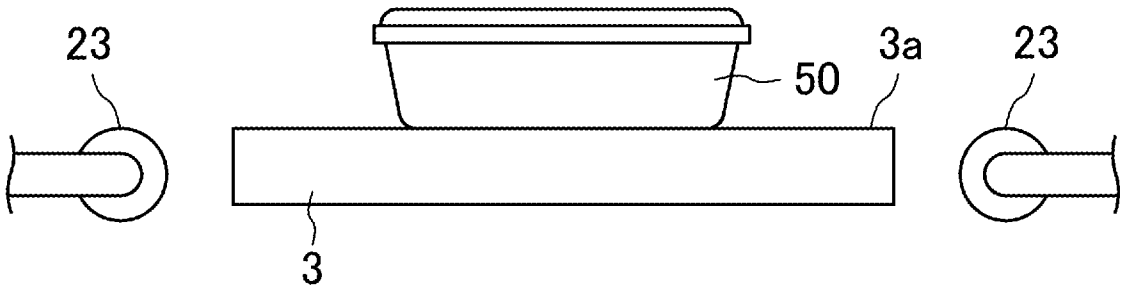
FIG. 2A A right side view generally illustrating the carry-in detecting step and the standby step according to the embodiment.
Figure 2B:
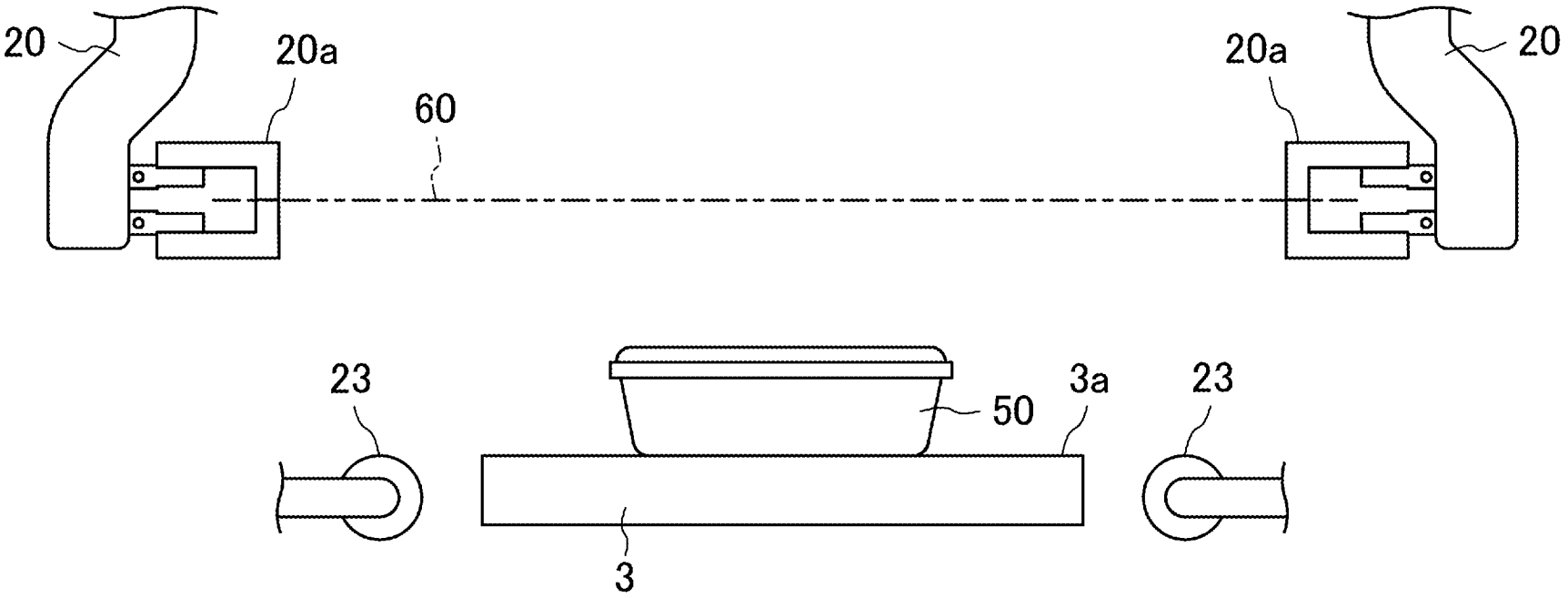
FIG. 2B A right side view illustrating the retraction step according to the embodiment.
Figure 2C:
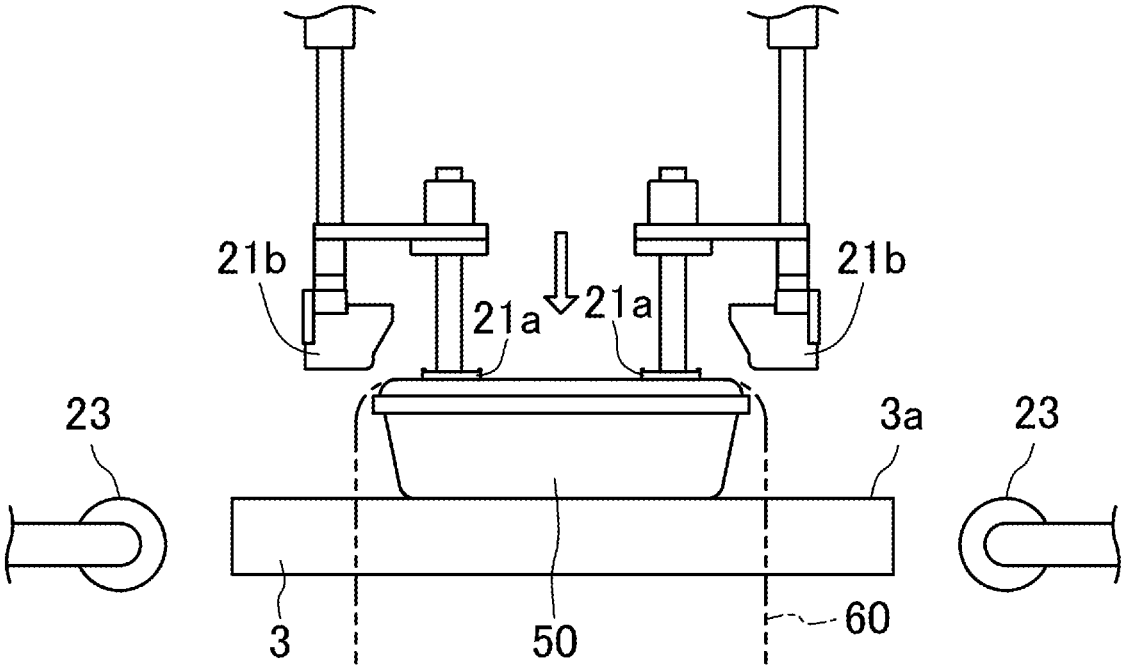
FIG. 2C A right side view generally illustrating the upper surface pressing operation in the packaging material attaching step according to the embodiment.
Figure 2D:
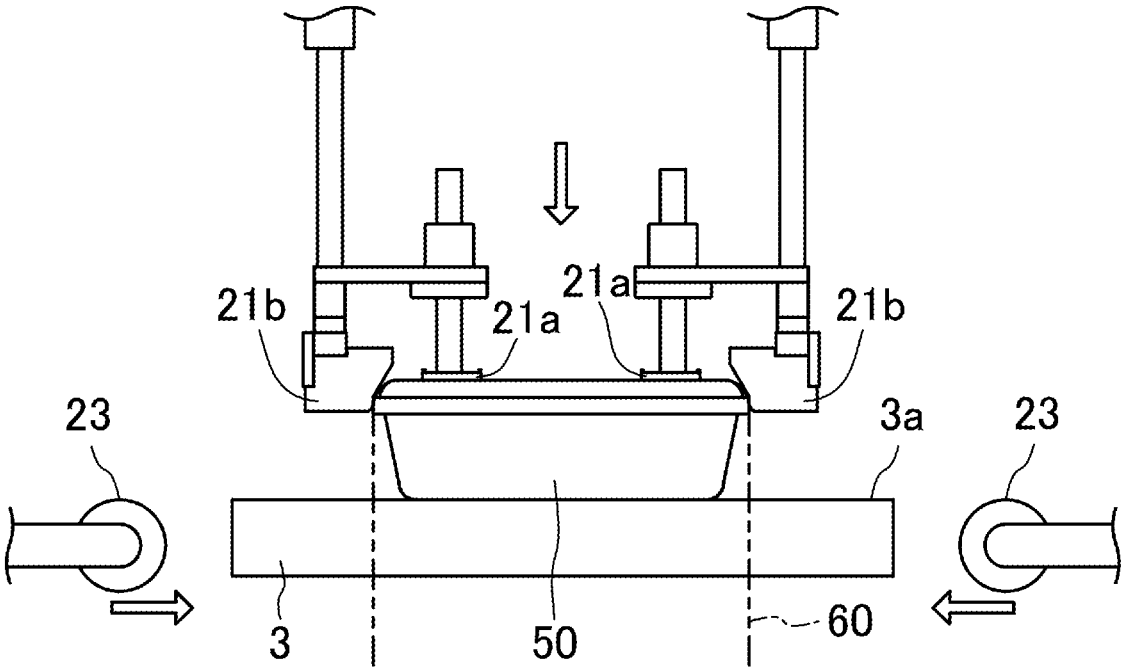
FIG. 2D A right side view generally illustrating the side surface pressing operation in the packaging material attaching step according to the embodiment.
Figure 2E:
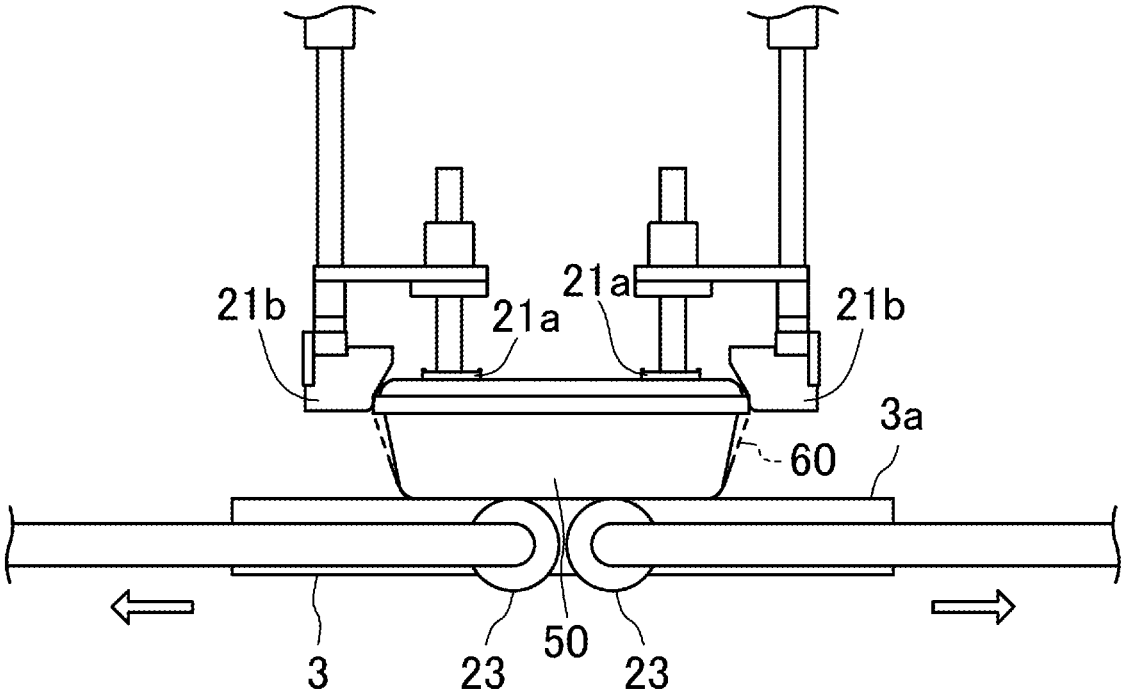
FIG. 2E A right side view illustrating the bottom folding operation in the packaging material attaching step according to the embodiment.

In addition, as illustrated in FIGS. 2D and 2E, the packaging material pressing mechanism 6 includes a pair of bottom folding rollers 23 that moves horizontally toward each other and attaches both end portions of the band-shaped packaging material 60 hanging down at side surfaces of the band-shaped packaging material 60 while pressing both end portions of the band-shaped packaging material 60 against the bottom surface of the food container 50. Although not specifically illustrated, the pair of bottom folding rollers 23 is slidable below the food container 50 by a motor or an air cylinder, for example, instructed by the control device 40 in the attachment space S.

As illustrated in FIG. 1A, a food container stopper 24 is disposed at the carry-out conveyor 8 of the packaging material pressing mechanism 6, and serves as an elevation object stopper that moves downward in attaching the band-shaped packaging material 60 to the food container 50 and restricts movement of the food container 50. The food container stopper 24 is configured to be movable upward and downward by an actuator (not shown) such as an air cylinder controlled by the control device 40, for example.

Next, an operation of the packaging device 1 according to this embodiment will be described.

Figure 6:
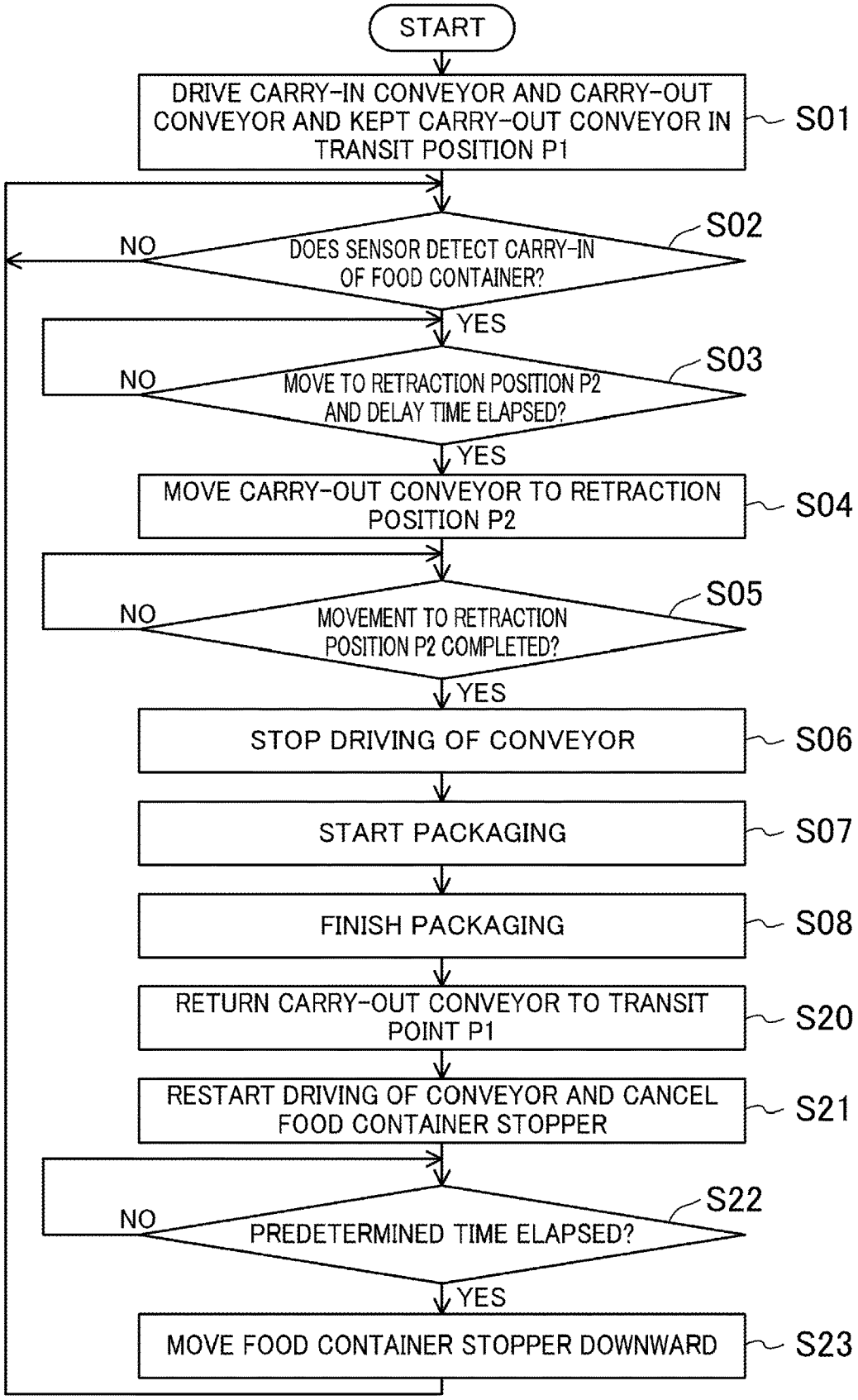
FIG. 6 A flowchart depicting a method for attaching a packaging material according to the embodiment of the present invention.
Figure 7:
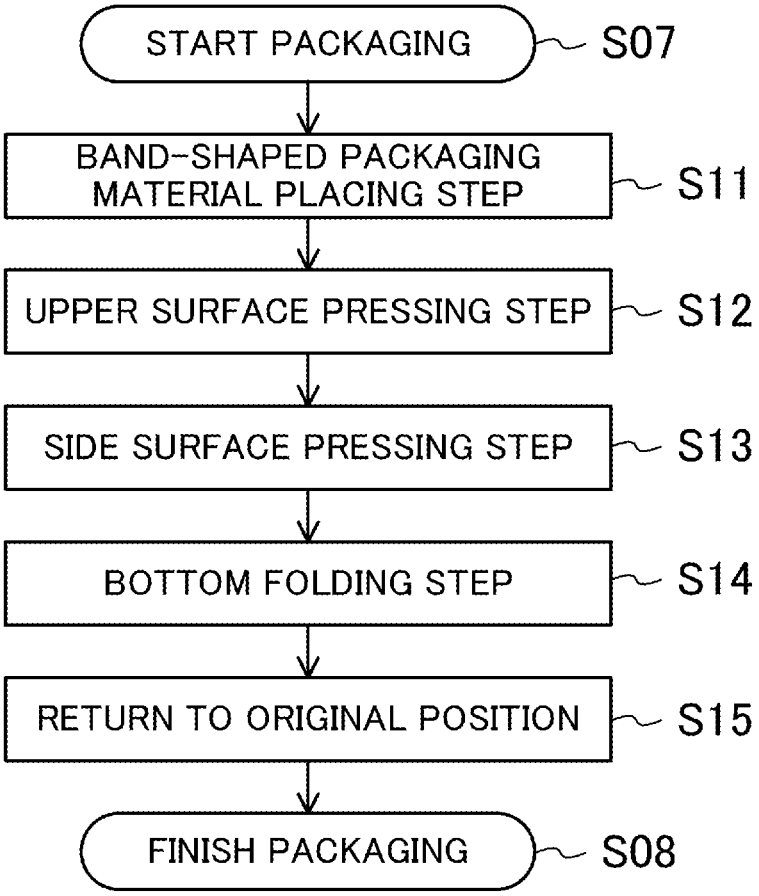
FIG. 7 A flowchart generally depicting a packaging process in the packaging method.

First, in a preparation step, the packaging device 1 with the configuration described above is prepared. The following control is performed by the control device 40, as shown in FIGS. 6 and 7.

Then, in a standby step of step S01, as shown in FIGS. 1A and 2A, the carry-out conveyor 8 is kept standby in a transit position P1 in which the downstream end of the carry-in conveyor 3 and the upstream end of the carry-out conveyor 8 are close to each other. The carry-in conveyor 3 and the carry-out conveyor 8 are in driven states, and the food container stopper 24 is lowered.

Thereafter, in a carry-in detecting step of step S02, a sensor 30 detects that the food container 50 is conveyed into the carry-in conveyor 3. The sensor 30 is configured to detect the food container 50 that has reached near an end of the carry-in conveyor 3. The detection method is not specifically limited, and a detection signal is transmitted to the control device 40.

Subsequently, in a retraction step, in step S03, after the sensor has detected that the food container 50 has been received in the carry-in detecting step, it is determined whether a predetermined time has elapsed or not, and then, the food container 50 is stopped by the food container stopper 24. Although not shown, the packaging material holding mechanism 20 swings downstream in the conveyance direction to grip one band-shaped packaging material 60 on which printing has been performed by the packaging material printing mechanism 5 beforehand.

Figure 1B:
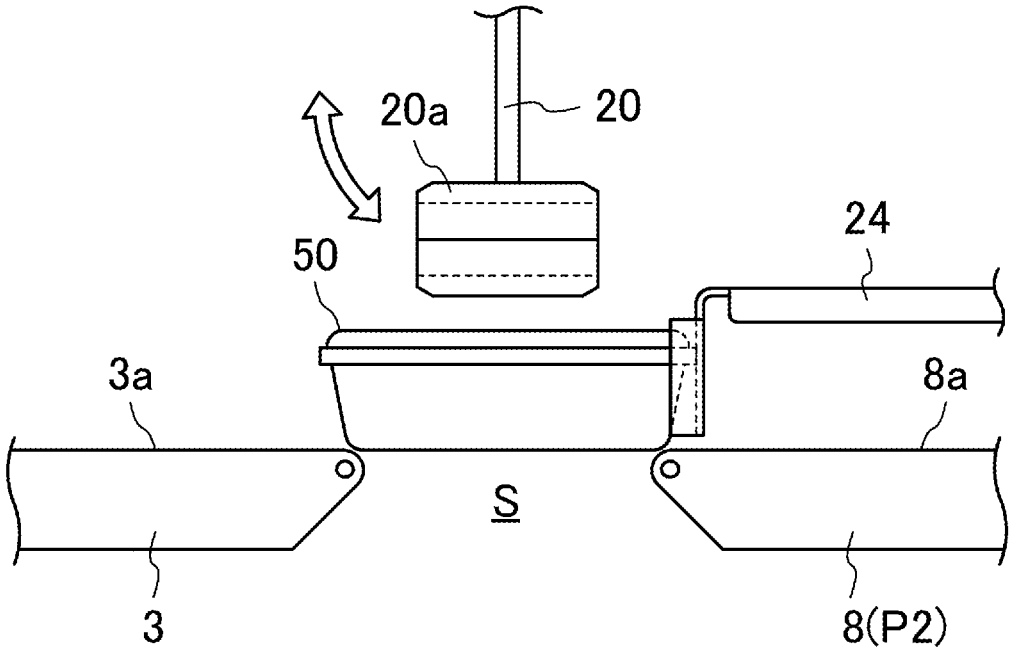
FIG. 1B A front view generally illustrating a retraction step according to the embodiment.

Then, in step S04, as illustrated in FIGS. 1B and 2B, when the carry-out conveyor 8 is moved to a retraction position P2 by the conveyor moving mechanism 9, an attachment space S of a size enough to prevent a fall of the food container 50 is formed between the carry-in conveyor 3 and the carry-out conveyor 8. The distance of movement of the carry-out conveyor 8 is instructed such that in specifying the food container 50 to be conveyed, the control device 40 instructs that the carry-out conveyor 8 moves to a predetermined distance. Thereafter, in step S05, when it is detected that movement to the retraction position P2 is completed, in a conveyor stop step of step S06, driving of the carry-in conveyor 3 and the carry-out conveyor 8 is stopped.

Then, in a packaging material attaching step of step S07, packaging is started. Here, the packaging material pressing mechanism 6 presses the band-shaped packaging material 60 against the food container 50 to attach the band-shaped packaging material 60 thereto by using the attachment space S.

In the packaging material attaching step, as shown in FIG. 7, in a band-shaped packaging material placing step of step S11, as illustrated in FIGS. 2B and 2B, the packaging material holding mechanism 20 pivots the band-shaped packaging material 60 whose both ends gripped by the clamps 20*a* and 20*a* to a downstream side. Subsequently, the band-shaped packaging material 60 is placed on the upper surface of the food container 50 such that both ends of the band-shaped packaging material 60 hang down at the side surfaces of the food container 50. As described above, the band-shaped packaging material 60 is supplied by the pair of clamps 20*a* and 20*a* while extending perpendicularly to the conveyance direction, and thus, a subsequent operation by the upper surface pressing mechanism 21 can be easily performed.

Figure 1C:
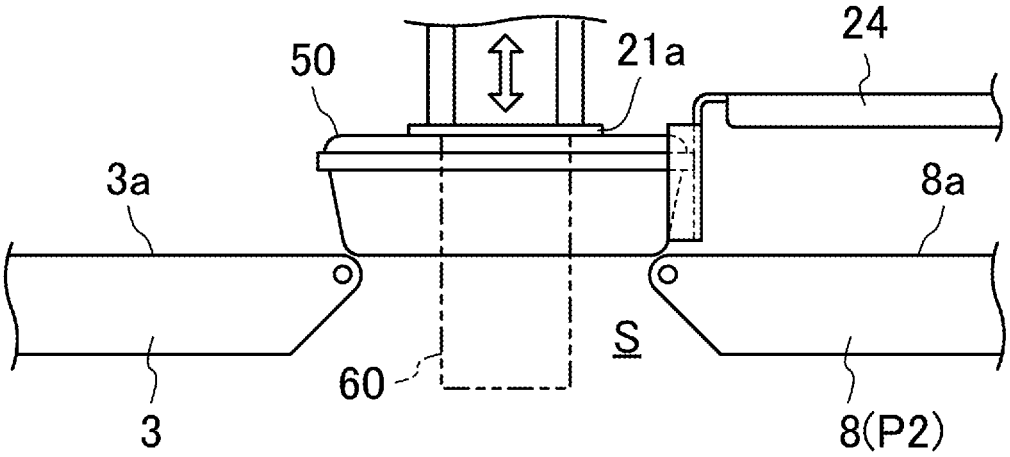
FIG. 1C A front view generally illustrating an upper surface pressing operation in a packaging material attaching step according to the embodiment.

Then, in an upper surface pressing step of step S12, as illustrated in FIGS. 1C and 2C, the upper surface pressing portion 21*a* of the upper surface pressing mechanism 21 is lowered so that the band-shaped packaging material 60 is pressed against the upper surface of the food container 50.

Figure 1D:
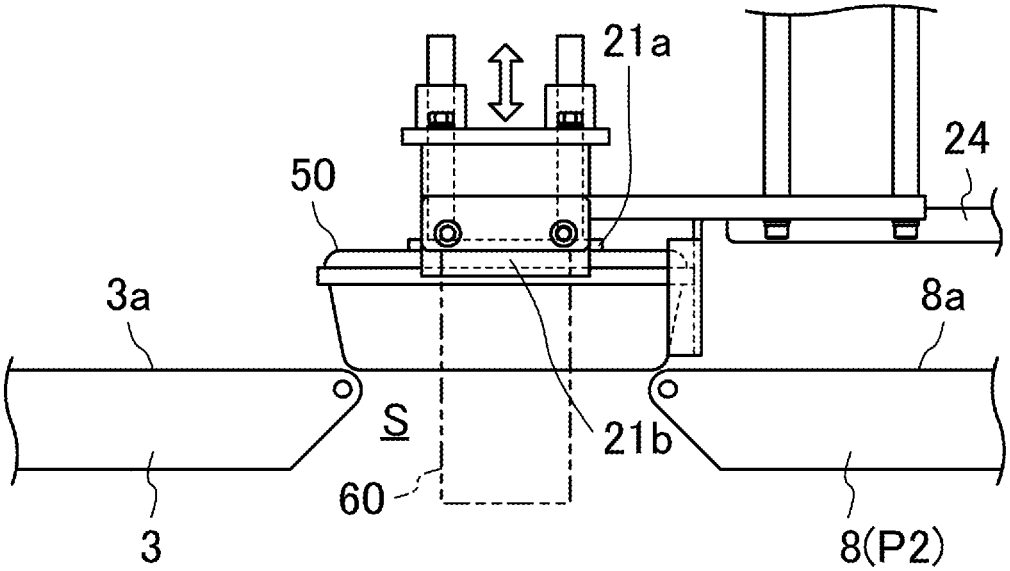
FIG. 1D A front view generally illustrating a side surface pressing operation in the packaging material attaching step according to the embodiment.

Thereafter, in a side surface pressing step of step S13, as illustrated in FIGS. 1D and 2D, the side surface pressing portion 21*b* of the upper surface pressing mechanism 21 is lowered so that the band-shaped packaging material 60 is pressed against both side surfaces of the food container 50. As described above, the side surface pressing portion 21*b* is movable independently of the upper surface pressing portion 21*a*. For example, as illustrated in FIG. 2C, the entire upper surface pressing mechanism 21 may moves downward first, and then as illustrated in FIG. 2D, only the side surface pressing portion 21*b* may move downward.

Figure 1E:
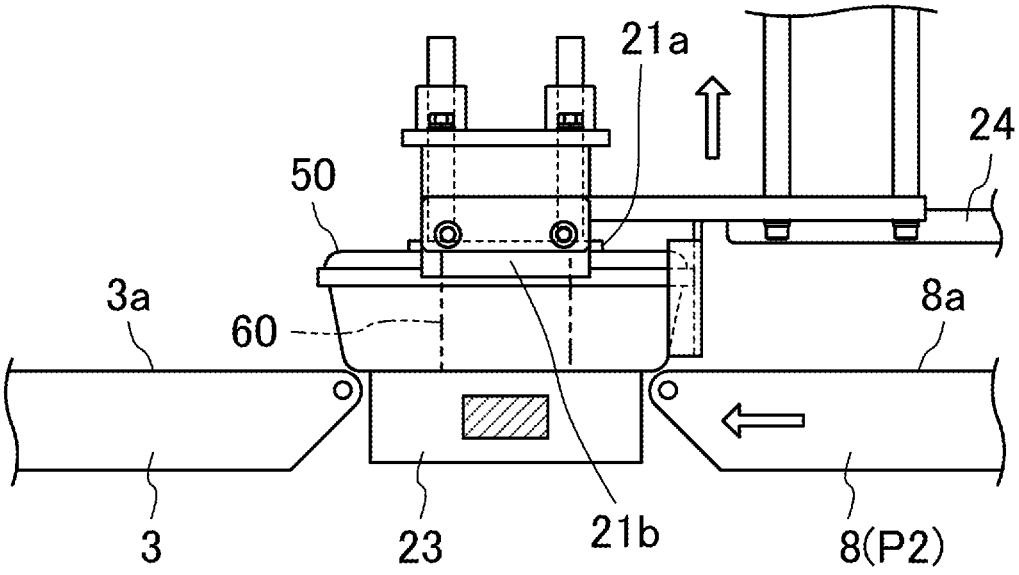
FIG. 1E A front view illustrating a bottom folding operation in the packaging material attaching step according to the embodiment.

Subsequently, in a bottom folding step of step S14, as illustrated in FIGS. 1E and 2E, the pair of bottom folding rollers 23 is horizontally moved toward each other so that both end portions of the band-shaped packaging material 60 hanging down at both side surfaces are pressed against the bottom surface of the food container 50 in the attachment space S to attach the band-shaped packaging material 60 to the bottom surface. As described above, since the bottom folding roller 23 presses the band-shaped packaging material 60 with the band-shaped packaging material 60 pressed against the food container 50 by the upper surface pressing portion 21*a* and the side surface pressing portion 21*b*, the band-shaped packaging material 60 can be attached to the food container 50 from the bottom surface to the upper surface thereof as intended.

Then, packaging is finished in step S08. In this embodiment, the packaging material pressing mechanism 6 presses the band-shaped packaging material 60 against the food container 50 to attach the band-shaped packaging material 60 to the food container 50 with the attachment space being kept therebelow by stopping movement of the food container 50 by the food container stopper 24. This ensures attachment of the band-shaped packaging material 60.

Then, in a conveyor re-driving step of step S20, after the packaging material attaching step, the carry-out conveyor 8 is returned to the transit position P1.

Thereafter, in step S21, the food container stopper 24 is lifted to be retracted. In this manner, the food container 50 can be carried out. Subsequently, driving of the carry-in conveyor 3 and the carry-out conveyor 8 are restarted, and the food container 50 to which the band-shaped packaging material 60 is attached is carried out. In this manner, after the attachment, it is sufficient to convey the food container 50 after returning the carry-out conveyor 8 to an original position after attachment. Thus, the food container 50 can be conveyed stably.

Then, in step S22, it is determined whether a predetermined time has elapsed or not. If a time substantially enough to allow the food container 50 to pass has elapsed, the process proceeds to step S23, and the food container stopper 24 is lowered again.

Subsequently, the process returns to step S02, and the operation is repeated.

As described above, in this embodiment, when the food container 50 is carried in, the carry-out conveyor 8 is moved to the retraction position P2, and the attachment space S is formed between the carry-in conveyor 3 and the carry-out conveyor 8 so that the packaging material pressing mechanism 6 attaches the band-shaped packaging material 60 to the food container 50 in this attachment space S. Thus, even a long band-shaped packaging material 60 extending from side surfaces to the bottom surface of the food container 50 can be attached as intended.

As a result, in the packaging device 1 according to this embodiment, it is possible to ensure attachment of the band-shaped packaging material 60 to the food container 50 from the upper surface to the bottom surface thereof while maintaining posture of the food container 50 by moving the carry-out conveyor 8 to form the attachment space S.

OTHER EMBODIMENTS

The embodiment of the present invention may have the following configurations.

Specifically, in the embodiment described above, when the food container 50 is carried in, only the carry-out conveyor 8 is moved to the retraction position P2. Alternatively, both the carry-in conveyor 3 and the carry-out conveyor 8 may be retracted to the retraction position or the carry-in conveyor 3 may be retracted to the retraction position.

In the embodiment described above, although the object is the food container 50, the object is not specifically limited as long as a long band-shaped packaging material 60 extending to the bottom surface is to be attached to the object.

The foregoing embodiments are merely preferred examples in nature, and are not intended to limit the invention, applications, and use of the application.

DESCRIPTION OF REFERENCE CHARACTERS

1 packaging device for packaging material
2 base frame
3 carry-in conveyor
3*a* conveyance surface
4 packaging material supply mechanism
5 packaging material printing mechanism
6 packaging material pressing mechanism
7, 7 lateral guide
8 carry-out conveyor
8*a* conveyance surface
8*b* carry-out conveyor motor
9 conveyor moving mechanism
10 centering device
20 packaging material holding mechanism
20*a*, 20*a* clamp
21 upper surface pressing mechanism
21*a* upper surface pressing portion
21*b* side surface pressing portion
23 bottom folding roller
24 food container stopper (object stopper)
30 sensor
40 control device
50 food container (object)
51 disc-shaped lid member
52 circular cross-section container portion
60 band-shaped packaging material
S attachment space
P1 transit position
P2 retraction position

The invention claimed is:

1. A packaging device for a packaging material, the packaging device comprising:

a carry-in conveyor configured to carry in an object along a conveyance direction;

a carry-out conveyor configured to carry out the object along the conveyance direction;

a conveyor moving mechanism configured to move at least one of the carry-in conveyor or the carry-out conveyor;

a packaging material pressing mechanism configured to press a band-shaped packaging material against the object conveyed between the carry-in conveyor and the carry-out conveyor, and to attach the band-shaped packaging material to the object; and a control device configured to cause the conveyor moving mechanism to move at least one of the carry-in conveyor or the carry-out conveyor to thereby form an attachment space between the carry-in conveyor and the carry-out conveyor, the attachment space being formed such that the band-shaped packaging material is attached to the object by the packaging material pressing mechanism in the attachment space, wherein the packaging material pressing mechanism includes a packaging material holding mechanism configured to place the band-shaped packaging material on an upper surface of the object such that both end portions of the band-shaped packaging material hang down at side surfaces of the object, an upper surface pressing mechanism configured to press the band-shaped packaging material supplied by the packaging material holding mechanism against the upper surface and a side surface of the object, and a pair of bottom folding rollers configured to move horizontally toward each other, the pair of bottom folding rollers being configured to press the both end portions of band-shaped packaging material hanging down at both side surfaces of the band-shaped packaging material against a bottom surface of the object and to attach the both end portions of the band-shaped packaging material to the bottom surface of the object, the pair of bottom folding rollers is movable below the object in the attachment space, the upper surface pressing mechanism includes an upper surface pressing portion configured to press the band-shaped packaging material against the upper surface of the object, and a side surface pressing portion configured to press the band-shaped packaging material against a side surface of the object, and the upper surface pressing portion and the side surface pressing portion are movable upward and downward independently of each other.

2. The packaging device according to claim 1, wherein the packaging material holding mechanism is configured to swing while gripping the both end portions of the band-shaped packaging material, and to place the band-shaped packaging material on the upper surface of the object, and includes a pair of openable clamps configured to release the both end portions of the band-shaped packaging material after the upper surface pressing portion presses the band-shaped packaging material against the upper surface of the object.

3. The packaging device according to claim 2, wherein an elevation object stopper is disposed at the carry-out conveyor, the object stopper moves downward in attaching the band-shaped packaging material to the object and restricts movement of the object.

4. The packaging device according to claim 1, wherein an elevation object stopper is disposed at the carry-out conveyor and is configured to move downward in attaching the band-shaped packaging material to the object and restrict movement of the object.

5. A packaging method comprising:

a preparation step of preparing a packaging device for a packaging material, the packaging device including a carry-in conveyor configured to carry in an object along a conveyance direction, a carry-out conveyor configured to carry out the object along the conveyance direction, a conveyor moving mechanism configured to move at least one of the carry-in conveyor or the carry-out conveyor, and a packaging material pressing mechanism configured to press a band-shaped packaging material against an object conveyed between the carry-in conveyor and the carry-out conveyor and to attach the band-shaped packaging material to the object;

a standby step of keeping the carry-out conveyor in a standby position in which a downstream end of the carry-in conveyor and an upstream end of the carry-out conveyor are close to each other;

a carry-in detecting step of causing a sensor to detect that the object is carried in to the carry-in conveyor;

a retraction step of moving at least one of the carry-in conveyor or the carry-out conveyor to a retraction position after a lapse of a predetermined time from detection of carry-in of the object in the carry-in detecting step;

a conveyor stop step of stopping driving of the carry-in conveyor and the carry-out conveyor after the retraction step;

a packaging material attaching step of causing the packaging material pressing mechanism to press the band-shaped packaging material against the object and attach the band-shaped packaging material to the object by using an attachment space between the carry-in conveyor and the carry-out conveyor; and a conveyor re-driving step of returning at least one of the carry-in conveyor or the carry-out conveyor to the transit position after the packaging material attaching step, and restarting driving of the carry-in conveyor and the carry-out conveyor, wherein in the packaging material attaching step, the band-shaped packaging material is placed on an upper surface of the object such that both end portions of the band-shaped packaging material hang down at side surfaces of the object, the band-shaped packaging material is pressed against the upper surface of the object and then against the side surfaces of the object, and a pair of bottom folding rollers is moved horizontally toward each other such that the both end portions hanging down at the side surfaces of the band-shaped packaging material are pressed against a bottom surface of the object and attached to the bottom surface in the attachment space.

* * * * *